US005522408A

United States Patent [19]

Wiegner

[11] Patent Number: 5,522,408

[45] Date of Patent: Jun. 4, 1996

[54] HAIR ROLLER

[76] Inventor: Georg Wiegner, 3/C Block 2, 16 la Salle Road, Kowloon/Hong Kong, Hong Kong

[21] Appl. No.: 481,193

[22] Filed: Jun. 7, 1995

Related U.S. Application Data

[63] Continuation of Ser. No. 138,635, Oct. 15, 1993, abandoned.

[30] Foreign Application Priority Data

Oct. 16, 1992 [DE] Germany ..... 42 35 025.5

[51] Int. Cl.[6] ..... A45D 2/14

[52] U.S. Cl. ..... 132/262; 132/226; 132/245; 132/247

[58] Field of Search ..... 132/227, 228, 132/246, 245, 226, 247, 251, 262

[56] References Cited

U.S. PATENT DOCUMENTS

| | | | |
|---|---|---|---|
| Re. 27,033 | 1/1971 | Mitsumoto . | |
| 1,718,025 | 6/1929 | Bishinger . | |
| 1,871,005 | 2/1930 | Freeman | 132/245 |
| 1,994,099 | 3/1935 | Fulton . | |
| 2,166,386 | 7/1939 | Auster . | |
| 2,171,885 | 9/1939 | Michael . | |
| 2,331,065 | 11/1939 | Willat . | |
| 2,404,517 | 7/1946 | Molchan . | |
| 2,631,593 | 3/1953 | Madore . | |
| 2,708,941 | 5/1955 | Field . | |
| 2,747,585 | 5/1956 | Allen et al. . | |
| 2,825,344 | 3/1958 | Lenois . | |
| 2,838,053 | 6/1958 | Zimmerman . | |
| 2,874,706 | 2/1959 | Ficicchy . | |
| 2,941,534 | 6/1960 | Otto et al. . | |
| 2,972,994 | 2/1961 | Ferens | 132/245 |
| 3,045,685 | 9/1958 | Cormier . | |
| 3,105,502 | 10/1963 | Mitchell et al. | 132/262 |
| 3,106,213 | 10/1963 | Clare | 132/262 X |
| 3,123,080 | 3/1964 | Brenn Albertoni | 132/262 |
| 3,204,646 | 9/1965 | Chamberlin . | |
| 3,267,942 | 8/1966 | Mestral | 132/262 |
| 3,388,709 | 6/1968 | Morris . | |
| 3,530,863 | 9/1970 | Foster . | |
| 3,624,749 | 11/1971 | Girard | 132/262 |
| 3,653,391 | 4/1972 | Andrews et al. | 132/245 |
| 3,666,915 | 5/1972 | De Napoli . | |
| 3,700,853 | 10/1972 | Jensen et al. . | |
| 3,759,271 | 9/1973 | Caruso . | |
| 3,812,866 | 5/1974 | Morane . | |
| 3,881,500 | 5/1975 | Shinbashi et al. . | |

(List continued on next page.)

FOREIGN PATENT DOCUMENTS

| | | |
|---|---|---|
| 0197208 | 4/1985 | European Pat. Off. . |
| 0460452 | 5/1991 | European Pat. Off. . |
| 2503996 | 4/1982 | France . |
| 2615079 | 3/1987 | France . |
| 1793426 | 2/1959 | Germany . |
| 1457375 | 3/1969 | Germany . |
| 2338330 | 2/1975 | Germany . |
| 7505892 | 2/1975 | Germany . |
| 2426028 | 12/1975 | Germany . |
| 2622364 | 12/1976 | Germany . |
| 2002226 | 2/1979 | Germany . |
| 3005837 | 9/1980 | Germany . |
| 3309241 | 3/1983 | Germany . |
| 3230357 | 2/1984 | Germany . |
| 3616076 | 11/1987 | Germany . |
| 1851705 | 11/1991 | Germany . |
| 1557333 | 1/1992 | Germany . |
| 2192786 | 1/1988 | United Kingdom . |
| 88/00445 | 1/1988 | WIPO . |

*Primary Examiner*—John G. Weiss
*Assistant Examiner*—Pedro Philogene
*Attorney, Agent, or Firm*—Steven F. Caserza; Flehr, Hohbach, Test, Albritton & Herbert

[57] ABSTRACT

A hair roller for rolling hair, with a roller core provided with openings or macropores and a selfgripping fabric tape fixed thereto having openings formed by webs on the reverse side of the adhesive fabric tape to permit moisture to escape when wet hair is being dried. The roller core has on its outer wall at least one stud which may be pushed through the open webs of the reverse side of the selfgripping fabric tape.

10 Claims, 1 Drawing Sheet

U.S. PATENT DOCUMENTS

| | | |
|---|---|---|
| 3,923,068 | 12/1975 | Gilman . |
| 3,943,946 | 3/1976 | Gallegos . |
| 4,298,787 | 11/1981 | Barradas . |
| 4,431,012 | 2/1984 | Brenn Albertoni . |
| 4,465,084 | 8/1984 | Fulgoni . |
| 4,516,011 | 5/1985 | Jeffress et al. . |
| 4,638,821 | 1/1987 | Smith . |
| 4,687,010 | 8/1987 | Caruso . |
| 4,699,159 | 10/1987 | Thaler . |
| 4,771,797 | 9/1988 | Kosaka . |
| 4,989,621 | 2/1991 | Keller . |
| 5,007,443 | 4/1991 | Fulgoni . |
| 5,117,090 | 5/1992 | Askins . |
| 5,144,968 | 9/1992 | Rivera . |
| 5,255,694 | 10/1993 | Caruso . |
| 5,263,501 | 11/1993 | Maznik . |
| 5,286,949 | 2/1994 | Simons . |
| 5,309,930 | 5/1994 | Presser . |

HAIR ROLLER

CROSS REFERENCE TO RELATED APPLICATIONS

This application is a continuation of U.S. application Ser. No. 08/138,635, filed Oct. 15, 1993, now abandoned.

FIELD OF THE INVENTION

The present invention relates to a hair roller for rolling up hair.

BACKGROUND OF THE INVENTION

Hair rollers can consist of a roller core, comprising openings allowing the moisture still present in the hair after washing to escape, and a selfgripping fabric tape attached thereto. The reverse side of the selfgripping fabric tape also comprises openings for the same reason, these being formed by a mesh-type web structure.

In hairdressing technology many types of hair rollers are known, which are used to roll up mainly female hair to produce curls. Such hair rollers are well known as curlers.

The technique of rolling up hair is not without problems as the hair tends to slip on a smooth roller. In addition, the hair must be tautly fastened to the hair roller for a certain length of time to ensure that curls will form.

Numerous types of hair rollers have been developed in order to simplify the rolling technique, all of which aim at facilitating initial binding of the hair to the hair roller.

Thus, for example, bundles of bristles in the shape of round brushes can be inserted into the core of the hair roller, the bristles then passing through the open web structure of the hair roller wall to form a brush-like surface on the hair roller. With bristles, the hair binds more easily at the outset, thus facilitating taut rolling. The same purpose is served by injection-molded rollers featuring plastic bristles on their surfaces.

With all above described hair rollers it is necessary to fasten the hair roll by means of clips, grips or pins after rolling. Such an operation requires dexterity and training, which is, of course, available at an adequately professional level in hairdressing salons.

An increasing number of women are, however, tending to curl their hair themselves in order to save the time-consuming and expensive trip to the hairdressing salon. Since the talent of the home hairdresser is naturally inferior to that of the professional stylist and there is usually no second person available to help, the technical demands on a hair roller for home use are therefore very much higher than on those hair rollers used in a professional environment.

This objective is fulfilled by selfgripping hair rollers on the basis of selfgripping fabric tapes.

Selfgripping fabric tape is widely known as a fastening system in the clothing trade, usually referred to as hook-and-loop fastening tape. In that particular application two tapes are used, namely one with numerous hooks and the other with as many loops on the surface. When the two tapes are brought together under application of slight pressure, they immediately engage and form a very firm fastening. The material of these extensively used selfgripping fabric tapes is usually synthetic, more specifically on the basis of polyamides such as nylon.

In the selfgripping hair roller only one layer of selfgripping fabric tape is necessary. The construction of the tape is modified such that the hooks are longer in order to exert an adequate binding effect on the rolled lock of hair and still to provide a sufficient binding effect for longer hair and thicker locks of hair. The rows of hooks are also connected by an open nylon mesh made of webbing through which the hot air of the hair dryer can easily pass.

The hair roller itself is well ventilated by openings in its outer sleeve.

The selfgripping fabric tape is permanently fastened to the roller core that usually also consists of plastic.

These hair rollers have achieved an exceptional degree of success, not only in the market for home hairdressing but also in hairdressing salons, and now have considerable market potential.

They simplify initial binding of the hair at the start of rolling, permit taut rolling, and require no pins, grips or clips. On completion of the rolling operation they hold the hair roll firmly in place without any additional means. In this procedure it is important that the self-gripping fabric tape tautly surround the roller core, does not have any folds and does not slip on the roller core.

However, such hair rollers have the disadvantage of being exceptionally expensive. This is due partly to the high price of the selfgripping fabric tape and partly to the still largely manual production technique.

Polypropylene has proved a very suitable and also inexpensive material for the roller core. The selfgripping fabric tape is wound round this roller core, which is available in up to 15 different diameters, and the ends heat welded together with a small overlap. The welding of nylon to nylon does not fuse with the polypropylene roller core lying underneath, so that the tape lies loosely on the core. Since the selfgripping fabric tape is not initially fixed at the start of winding around the core, it is often very loosely wound and tends to form folds during the hair rolling operation.

Many attempts have been made to remedy these deficiencies. The welding seam, for instance, has been executed to a depth at which the plastic material of the core below also melts, resulting in a flow of material into the selfgripping nylon tape, thus giving the latter a certain mechanical anchorage.

In many cases, however, the nylon tape then becomes so thin that it will easily break. In addition, such a weld seam is very ugly in appearance and often has fused hard ends projecting beyond the edge of the roller. Another disadvantage of this process is that only a small segment of approximately 5° of the circumference of the hair roller is firmly connected, the remaining 355° resting loosely on the roller core.

OBJECTS OF THE INVENTION

It is an object of the invention to avoid these disadvantages and provide an improved hair roller which permits simple handling of the hair roller even by the person wearing this hair roller.

Another object is to provide an improved hair roller which guarantees secure fastening of the hair to the hair roller, enables taut rolling and is capable of being produced by mechanical means.

SUMMARY OF THE INVENTION

According to the invention these objects are attained by a hair roller whose roller core features on its outer wall at least one, more appropriately two and more advantageously four or more studs that can be pushed into the reverse side of the self-gripping fabric tape. The studs on the outer wall of the roller core provide the advantage that, while the selfgripping fabric tape is being wound on around the roller core, the stud or studs immovably and firmly attach the selfgripping fabric tape to the roller core, that the tape is firmly anchored, and that the application of the hair roller is considerably facilitated and can easily be performed by a person in the hairdressing salon or even by the home user herself or himself. The fixing of the selfgripping fabric tape to the roller core represents another advantage in that the production of the hair roller can be mechanized and that, by contrast to the previous manual methods, production in a factory is now possible.

One single stud on the outer sleeve of the roller core is sufficient to achieve the desired technical effect. It is then appropriately arranged in a central position relative to the axis in order to achieve uniform rolling of the hair over the width of the hair roller. Moreover appropriate, however, are several studs, preferably two to four, arranged as symmetrically as possible around the circumference of the outer sleeve since the wet hair can then be rolled up with greater force and more tautly.

If two studs are used, these are appropriately arranged 180° apart on the periphery of the outer sleeve and, more advantageously still, in a central position relative to the axis. If three or more studs are used, it is in all cases preferable to stagger their location both in direction of the axis and on the periphery of the outer sleeve, as this achieves uniform, effective rolling of the hair.

The diameter of the stud is appropriately greater than the distance between neighboring strands on the reverse side of the selfgripping fabric tape so that it connects the selfgripping fabric tape and the roller core by clamping. The diameter of the stud appropriately corresponds to approximately twice the distance between two neighboring strands.

The simple handling and the sure firm clamping of the selfgripping fabric tape to the roller core can be improved still further by providing the stud with a groove running all or partly round its base into which the strands flanking the opening of the adhesive fabric tape engage when the self-gripping fabric tape is being wound round the roller core, hence fixing the tape immovably to the roller core.

The reverse side of the selfgripping fabric tape is preferably a polyamide, more specifically a nylon mesh formed by strands, and which the selfgripping fabric tape is fastened and which is distinguished by great strength and elasticity, so that the stud can be pushed through under relatively strong pressure. This construction of the reverse side of the selfgripping fabric tape is especially suited for a roller core comprising one stud with a circumferential groove, as the strands of the nylon mesh can engage in the groove once the stud has been pushed through and thus afford particularly secure fastening of the selfgripping fabric tape to the roller core.

This security can be further increased in a stud of thermoplastic synthetic material by subsequently applying heat to the pointed tip of the stud, which facilitates penetration into the selfgripping fabric tape, to render the stud mushroom-shaped and hence blunted.

In terms of material, the roller core and the studs affixed to its outer sleeve can be very different substances such as ceramics, sheet metal or aluminum. Of the suitable materials, plastic is preferred. Among plastics, the preferred material is polypropylene, which is distinguished by its low cost of manufacture, but above all by its easy moldability and its inertness. Especially preferred for the solution of the set task is a one-piece roller core, preferably injection molded embodying all essential functional parts, so that the hair roller comprises only two parts, namely the roller core and the self-gripping fabric tape fixed thereto by means of the stud.

This simple construction consisting of only two parts fastened by a simple but secure interlock permits economic and mechanical production and therefore great savings in time and in the labor hitherto required, and thus very much more efficient manufacture overall.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
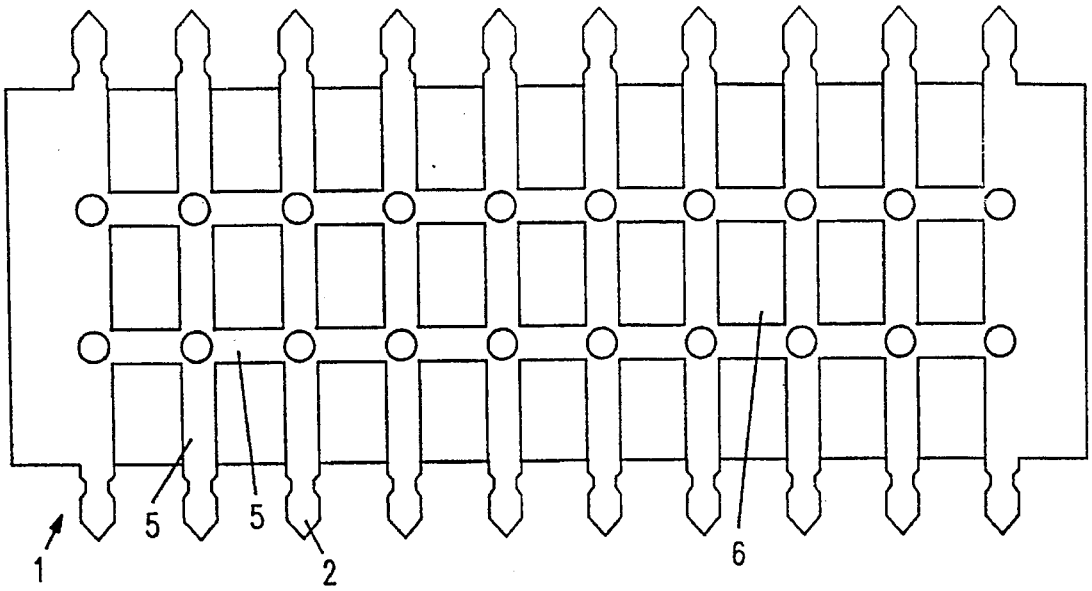
FIG. 1 is an elevational view of the roller core.
Figure 2:
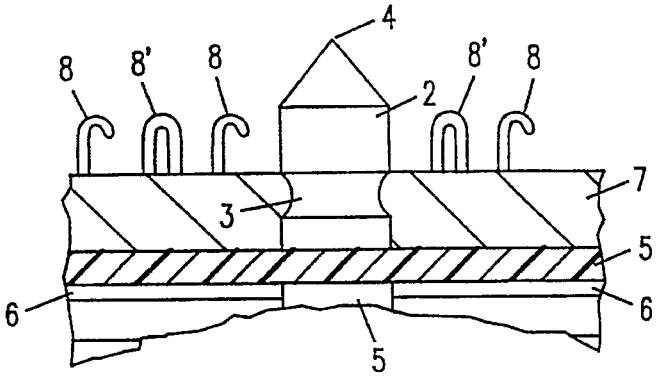
FIG. 2 is a highly diagrammatic enlarged cross sectional representation of the stud on the roller core.
Figure 3:
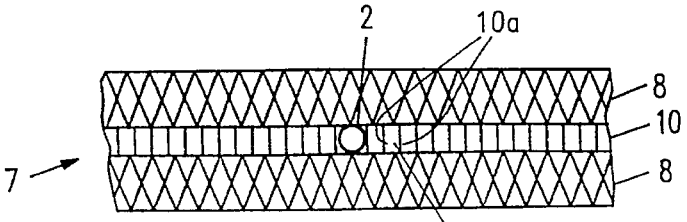
FIG. 3 is a top view of the tip of the stud after penetration between two neighboring webs or strands of the self-gripping fabric of the adhesive fabric tape.

The roller core 1 comprises an injection-molded polypropylene part whose structure is a grid built of webs 5. The webs 5 enclose a relatively large fee space 6, so that air may easily pass through the roller core 1 and the hair during blow-drying or otherwise of the hair. On the roller core 1 are located studs having a groove 3 at their base and a pointed tip located studs 2. Each of the studs has a groove 3 at its base and a pointed tip 4 at its unattached end. In the example illustrated herein, a stud 2 is located at each intersection point of the webs 5 of the stud.

The self-gripping fabric tape 7 wound around the roller core 1 consists of alternating rows of selfgripping fabric tape hooks 8 or loops 8' and nylon mesh 10, (having strands **10*a* defining openings 10*b*** between them). The fabric tape is also relatively open in order to permit easy passage of air.

When the selfgripping fabric tape 7 is wound round the roller core 1, the pointed tip 4 of the stud 2 penetrates the nylon mesh 10 of the selfgripping fabric tape 7, and the stud 2 engages in the selfgripping fabric tape 7. The tape is held by means of the groove 3 which receives strands of the mesh 10 and thus ensures a firm fastening of the selfgripping fabric tape 7 to the roller core 1.

The roller core and/or studs may be of thermoplastic synthetic material, ceramics, porous earthenware, impermeable earthenware, synthetic ceramics, sheet metal, aluminum or wood, or of a combination of any of these materials.

I claim:

1. A hair roller comprising:

a roller core formed with an array of openings and with a radially outwardly projecting stud; and a self-gripping fabric tape placed externally to the core, providing with outwarded projecting hooks and formed of strands defining openings through one of which openings the stud projects.

2. The hair roller defined in claim 1 wherein the roller core has two to four such studs on its outer wall.

3. The hair roller defined in claim 1 wherein the stud has a pointed tip.

4. The hair roller defined in claim 1 wherein the roller core is made of a material selected from the group which consists of thermoplastic synthetic material, ceramics, porous earthenware, impermeable earthenware, synthetic ceramics, sheet metal, aluminum and wood and combinations thereof.

5. The hair roller defined in claim 1 wherein at least two such studs are arranged at 180° to each other on a periphery of a circular cross-section of the roller core.

6. The hair roller defined in claim 1 wherein additional such studs are arranged on the core, staggered relative to each other in an axial direction on the outer wall of the roller core.

7. A hair roller as in claim 1 wherein said stud comprises a groove.

8. The hair roller defined in claim 7 wherein said groove is provided at a base of the stud.

9. A hair roller as in claim 7 wherein said groove comprises a circumferential groove.

10. A hair roller as in claim 7 wherein said strands define an opening engaged in said groove of said stud.

* * * * *